US005284417A

United States Patent [19]

Yu

[11] Patent Number: 5,284,417

[45] Date of Patent: Feb. 8, 1994

[54] AUTOMOTIVE FUEL PUMP WITH REGENERATIVE TURBINE AND LONG CURVED VAPOR CHANNEL

[75] Inventor: Dequan Yu, Ann Arbor, Mich.

[73] Assignee: Ford Motor Company, Dearborn, Mich.

[21] Appl. No.: 72,018

[22] Filed: Jun. 7, 1993

[51] Int. Cl.[5] ..... F04D 9/00

[52] U.S. Cl. ..... 415/55.1

[58] Field of Search ..... 415/55.1, 55.2, 55.3, 415/55.4, 55.5, 169.1

[56] References Cited

U.S. PATENT DOCUMENTS

| | | | |
|---|---|---|---|
| 4,508,492 | 4/1985 | Kusakawa et al. | 415/55.1 |
| 4,573,882 | 3/1986 | Watanabe et al. | 415/55.1 |
| 4,591,311 | 5/1986 | Matsuda . | |
| 4,793,766 | 12/1988 | Kumata | 415/55.1 |
| 5,009,575 | 4/1991 | Hanai et al. | 415/55.1 |
| 5,080,554 | 2/1992 | Kamimura | 415/55.1 |
| 5,192,184 | 3/1993 | Nobuo et al. | 415/55.1 |
| 5,221,178 | 6/1993 | Yoshioka et al. | 415/55.1 |

FOREIGN PATENT DOCUMENTS

| | | | |
|---|---|---|---|
| 752398 | 10/1952 | Fed. Rep. of Germany | 415/55.1 |
| 888208 | 8/1953 | Fed. Rep. of Germany | 415/55.1 |
| 138297 | 7/1985 | Japan | 415/55.1 |
| 175297 | 7/1986 | Japan | 415/55.1 |
| 160192 | 7/1991 | Japan | 415/55.1 |

*Primary Examiner*—John T. Kwon

*Attorney, Agent, or Firm*—Jerome R. Drouillard; Roger L. May

[57] ABSTRACT

A pump for supplying gasoline to the fuel injectors of an automotive engine includes a pump case, and upper and lower pump housings mounted within the case and forming an annular pumping channel. The pumping channel includes a vapor channel extending along an axially enlarged section of the bottom portion of the pumping channel from the pump's inlet to a purge orifice which extends axially through the lower pump housing from a radially inward portion of the pumping channel.

8 Claims, 1 Drawing Sheet

AUTOMOTIVE FUEL PUMP WITH REGENERATIVE TURBINE AND LONG CURVED VAPOR CHANNEL

BACKGROUND OF THE INVENTION

The present invention relates to an automotive fuel pump for use with a gasoline fuel injection system. In order to achieve proper performance of a fuel injection system, it is necessary that the pump supply only liquid fuel, not vapor-contaminated fuel, to the fuel injectors. A pump according to the present invention will easily rid itself of vapor so as to furnish good quality liquid fuel to the fuel injectors, with high efficiency unimpaired by excessive pumping losses resulting from turbulence.

DESCRIPTION OF THE PRIOR ART

U.S. Pat. No. 4,591,311 to Matsuda et al discloses an automotive fuel pump having a vapor dam for purging fuel vapor from the liquid being pumped. The vapor dam is characterized by a short step portion, which, although perhaps serving to conduct unwanted vapor into a purge orifice, will cause unnecessary turbulence in the mainstream of the fluid. On the other hand, a purge means according to the present invention, including a vapor channel which gradually closes to a purge orifice, will promote and allow the removal of vapor from the pumped gasoline without causing undesirable turbulence or pumping losses.

SUMMARY OF THE INVENTION

According to the present invention, a pump for supplying gasoline to the fuel injectors of an automotive engine includes a pump case, an upper pump housing mounted within the case and defining an upper race of an annular pumping channel having a pump outlet, and a lower pump housing also mounted within the case and defining a lower race of an annular pumping channel, having a pump inlet in a bottom portion of the lower race, and with the upper and lower pump housings cooperating to form a complete pumping channel for a rotary pumping element. A motor mounted within the case and having a shaft extending therefrom powers a rotary pumping element housed between the upper and lower pump housings. A pump according to the present invention further includes purge means for expelling gasoline vapor from the pumping channel. The purge means preferably comprises a vapor channel extending along an axially enlarged section of the bottom portion of the pumping channel. The vapor channel extends from the pump inlet to a purge orifice which extends axially through the lower pump housing from a radially inward portion of the pumping channel. The vapor channel terminates in a transition section in which the vapor channel is reduced from the full width of the bottom portion of the pumping channel to a width approximating the diameter of the purge orifice. The transition section preferably extends along approximately a 20°-30° segment of the pumping channel. The vapor channel itself extends approximately 100°-120° from the pump inlet to the purge orifice.

The vapor channel may be formed not only by an axial enlargement of the bottom portion of the lower race of the pumping channel, but also by an axially upwardly extending portion of the upper race of the annular pumping channel.

DETAILED DESCRIPTION OF THE PREFERRED EMBODIMENT

Figure 2:
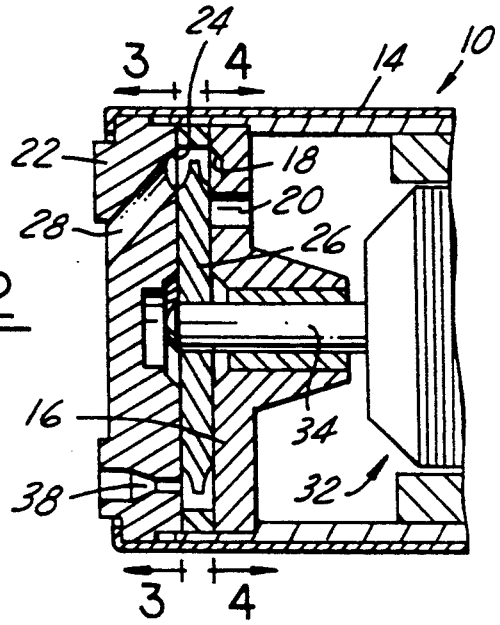
FIG. 2 is a cross-sectional view of a pump according to the present invention.

As shown in FIG. 2, an automotive fuel pump 10 has a case 14 enclosing an upper pump housing 16 having an upper race 18 which defines part of an annular pumping channel, and a pump outlet 20. Case 14 also encloses a lower pump housing 22 having lower race 24 contained therein. Together, upper pump housing 16 and lower pump housing 22 cooperate to form a complete pumping channel for a rotary pumping element, with the pumping channel being defined by upper race 18 and lower race 24.

Figure 3:
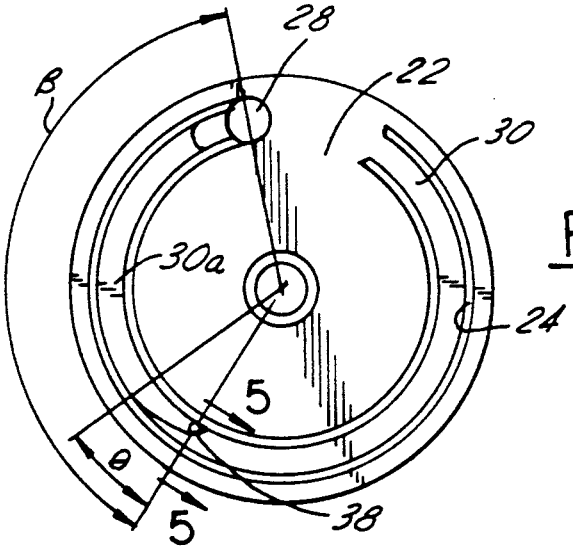
FIG. 3 is a plan view of a lower pump housing according to the present invention, taken along line 3—3 of FIG. 2.

Fuel being processed by pump 10 enters the pump through inlet 28 which, as shown in FIGS. 2 and 3, communicates with one end of lower race 24. Fuel entering lower race 24 through inlet 28 is picked up by rotary pumping element 36 (FIG. 2) which, in this case, comprises a regenerative turbine. The turbine is driven by motor 32 having a shaft 34 extending therefrom, upon which pumping element 36 is mounted.

Figure 1:
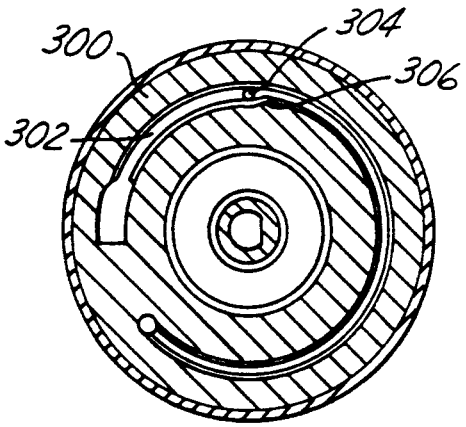
(PRIOR ART) FIG. 1
FIG. 1 is a sectional view of a prior art pump housing.

Fuel is circulated from pump inlet 28 to outlet 20. As with many other pumping devices, regenerative turbine pumps work best with fluid in a single phase. Accordingly, it is highly desirable to most of the vapor from the gasoline being pumped. Thus, it has been known, as shown in FIG. 1, to provide a purge orifice in the pumping channel. Accordingly, orifice 304 is illustrated in FIG. 1. In order to urge fluid containing vapor to flow through orifice 304, the pump of FIG. 1 has a step 306, formed in the inner wall of the pumping channel. Although such a step may effectively cause vapor to be purged from the fluid flow, the abrupt change in flow may tend to induce turbulence in the pumped liquid which will undesirably cause pressure loss and impair pumping efficiency. Other prior art vapor purging systems utilize blunt-ended vapor channels which may produce undesirable turbulence.

Figure 4:
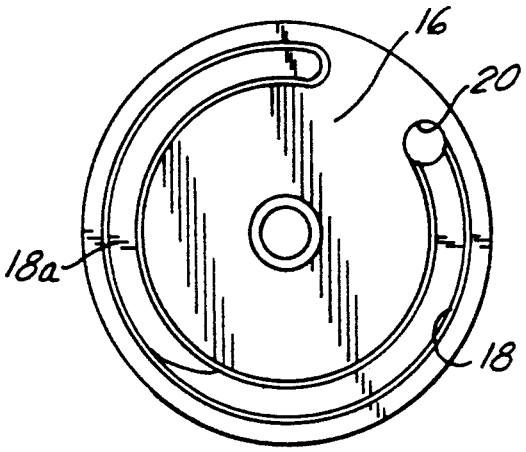
FIG. 4 is a plan view of an upper pump housing according to the present invention taken along the line 4—4 of FIG. 2.

The inventive purging system shown in FIGS. 2, 3, and 4 allows efficient purging of vapor from the pumped liquid without concomitant losses in pressure and without creation of turbulent flow. Fuel vapors are entrained in a purge flow comprising a mixed-phase fluid which is moved along a vapor channel and through a purge orifice 38 (FIG. 3), located at a radially inward portion of the pumping channel. The mixed-phase fluid passes through a vapor channel formed by an axially enlarged section of the bottom portion of lower race 24. This enlarged section, which is labeled as 30*a* in FIG. 3, is depressed approximately 0.7 mm from the remaining portion of surface 30, which is the nominal bottom of lower race 24. The overall width of lower race 24 is approximately 3.2 mm, with the mean diameter of the lower and upper races being about 38 mm.

Section 30*a* extends anti-clockwise from pump inlet 28 through an arc, $\beta$, which is approximately 100°-120° of rotation (FIG. 3). It is believed that a $\beta$ arc length of about 113° will produce satisfactory results. Along the arc segment $\theta$ of section 30*a*, which comprises approximately 20°-30°, and preferably 27° of the pumping channel, the vapor channel terminates in a transition section in which the vapor channel is reduced from the full width of the bottom portion 30*a* of the pumping channel to a width approximating the diameter of purge orifice 38. This gradual transition allows vapor to be purged from the liquid fuel without causing the problems of turbulent flow which have previously been noted.

If a pump according to the present invention is constructed with a regenerative turbine, it is desirable to include a vapor channel in not only the lower race but also in the upper race, as illustrated at 18*a* of FIG. 4. As may be seen from FIGS. 3 and 4, the upper and lower parts of the vapor channel are symmetrical with each other.

Figure 5:
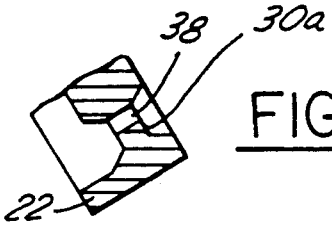
FIG. 5 is a partial section, broken away, of the lower pump housing of FIG. 3 taken along the line 5—5 of FIG. 3.

As shown in FIG. 5, purge orifice 38 extends axially through lower pump housing 22, through a radially inward portion of the bottom 30*a* of the pumping channel.

While pump 10 is in operation, mixed phase fluid entering pumping inlet 28 will move through the vapor channel defined by sections 18*a* and 30*a* of upper race 18 and lower race 24 in a counterclockwise direction as viewed in FIG. 3. Upon reaching transition section 8, the fluid flowing through the vapor channel will be smoothly extracted through purge orifice 38 because of the gradual transition through section $\theta$, and as a result, there will be minimal disruption to the fluid flowing through the main portion of the pumping channel. Smooth extraction of the fluid flowing through the vapor channel portion of the pumping channel is important because those skilled in the art will appreciate in view of this disclosure that fluid is continuously discharged through purge orifice 38 and, as a result, the turbulence produced by purge orifices and accompanying dam structures found in prior art pumps such as that illustrated in FIG. 1 will not occur with the present pump. A pump according to the present invention is well-suited to mounting within the fuel tank of a motor vehicle because the purge flow may be easily accommodated by discharging the flow directly into the tank.

I claim:

1. A pump for supplying gasoline to fuel injectors of an automotive engine, comprising:

a pump case;

an upper pump housing mounted within said case and having an upper race of an annular pumping channel, with a pump outlet extending therethrough;

a lower pump housing mounted within said case and having a lower race of an annular pumping channel with a pump inlet and a bottom portion, with said upper and lower pump housings cooperating to form a complete pumping channel for a rotary pumping element;

a motor mounted within the case and having a shaft extending therefrom;

a rotary pumping element mounted to said motor shaft and housed between said upper and lower pump housings; and purge mans for expelling gasoline vapor from said pumping channel, with said purge means comprising a vapor channel extending along an axially enlarged section of the bottom portion of said pumping channel from the pump inlet to a purge orifice extending axially through said lower pump housing from a radially inward portion of the pumping channel, with said vapor channel terminating in a transition section in which the vapor channel is reduced from the full width of the bottom portion of the pumping channel to a width approximating the diameter of the purge orifice.

2. A pump according to claim 1, wherein aid transition section extends along approximately a 20°-30° arc segment of said pumping channel.

3. A pump according to claim 1, wherein said vapor channel extends not only along the bottom portion of the lower race, but also along an upper portion of the upper race.

4. A pump according to claim 1, wherein said rotary pumping element comprises a regenerative turbine.

5. A pump according to claim 1, wherein said vapor channel extends through an arc segment of approximately 100°-120° from the pump inlet to the purge orifice.

6. A pump according to claim 1, wherein said pump is adapted for mounting within the fuel tank of a motor vehicle.

7. A pump for supplying gasoline to the fuel injectors of an automotive engine, comprising:

a pump case;

an upper pump housing mounted within said case and defining an upper race of an annular pumping channel;

a lower pump housing mounted within said case and defining a lower race of an annular pumping channel having a pump inlet and a bottom portion, with said upper and lower pump housings cooperating to form a complete pumping channel for a rotary pumping element;

a motor mounted within the case and having a shaft extending therefrom;

a regenerative turbine pumping element mounted to said motor shaft and housed between said upper and lower pump housings; and purge means for expelling gasoline vapor from said pumping channel, with said purge means comprising a vapor channel extending through an arc length of approximately 100°-120° along an axially enlarged section of the bottom portion of said pumping channel from the pump inlet to a purge orifice extending axially through said lower pump housing from a radially inward portion of the pumping channel, with said vapor channel terminating in a transition section in which the vapor channel is reduced from the full width of the bottom portion of the pumping channel to a width approximating the diameter of the purge orifice, and with said transition section extending along an arc length of approximately 20°-30° of said pumping channel.

8. A pump according to claim 7, wherein said vapor channel extends not only along the bottom portion of the lower race, but along an upper portion of the upper race, with said upper and lower parts of the vapor channel being symmetrical with each other.

* * * * *